United States Patent [19]

Borel et al.

[11] Patent Number: 4,554,953

[45] Date of Patent: Nov. 26, 1985

[54] COMPOSITE FABRIC FOR USE AS CLOTHING FOR THE SHEET FORMING SECTION OF A PAPERMAKING MACHINE

[75] Inventors: Georg Borel; Hartmut Waldvogel, both of Reutlingen, Fed. Rep. of Germany

[73] Assignee: Hermann Wangner GmbH & Co., Reutlingen, Fed. Rep. of Germany

[21] Appl. No.: 576,419

[22] Filed: Feb. 2, 1984

[30] Foreign Application Priority Data

Feb. 18, 1983 [DE] Fed. Rep. of Germany ..... 3305713

[51] Int. Cl.[4] ..... D03D 23/00

[52] U.S. Cl. ..... 139/383 A; 139/425 A; 162/DIG. 1; 428/223; 428/257

[58] Field of Search ..... 428/221, 223, 224, 225, 428/257, 178, 188; 139/425 A, 383 A; 162/DIG. 1

[56] References Cited

U.S. PATENT DOCUMENTS

| | | | |
|---|---|---|---|
| 1,991,366 | 2/1935 | Barrell | 139/410 |
| 2,047,542 | 2/1933 | Barrell | 139/410 |
| 2,209,874 | 10/1939 | Dempsey | 139/410 |
| 2,741,824 | 4/1956 | Robbins et al. | 428/225 |
| 3,013,588 | 12/1961 | Klingberg | 428/225 |
| 3,885,603 | 5/1975 | Slaughter | 139/425 A |
| 3,943,980 | 3/1976 | Rheaume | 428/178 |
| 4,395,336 | 7/1983 | Eng | 428/224 |

FOREIGN PATENT DOCUMENTS

| | | | |
|---|---|---|---|
| 40-15842 | 7/1940 | Japan | 139/383 A |
| 451752 | 8/1936 | United Kingdom . | |

*Primary Examiner*—James J. Bell

[57] ABSTRACT

A composite fabric comprising at least two fabric layers interconnected by transversely or by longitudinally extending threads and wherein at least a part of the transversely extending and at least a part of the longitudinally extending interconnecting threads are woven both into the upper and into the lower fabric layer.

6 Claims, 5 Drawing Figures

COMPOSITE FABRIC FOR USE AS CLOTHING FOR THE SHEET FORMING SECTION OF A PAPERMAKING MACHINE

BACKGROUND OF THE INVENTION

The invention relates to a composite fabric for use as clothing for the sheet forming section of a papermaking machine. In particular it relates to a composite fabric of the aforementioned type having at least two fabric layers formed by transversely and by longitudinally extending threads and interconnected by transversely or by longitudinally extending threads.

Clothings for the sheet forming section of a papermaking machine, so-called papermachine screens, have to meet rigid requirements. The paper supporting side of a papermachine screen has to be be designed so that it leaves minimal marks in the paper. Owing to the increase in costs for raw materials and the growing use of waste paper having a high content of short fibers, good retention is also important. The underside, or running side, of the papermachine screen is subject to high wear on account of the high operating speeds and the use of less expensive filler material that is more prone to abrasion. This high wear tends to decrease the service life of the papermachine screen. The power input of the screen section is furthermore limited, in part by the exhaustion of the installed power and, in part by the high cost of energy.

Attempts to meet these partially conflicting requirements for papermachine screens have resulted in the development of screens containing a plurality of fabric layers loosely interconnected by additional binder threads. German Offenlegungsschriften Nos. 2,455,184 and 2,455,185 describe circularly woven papermachine screens of this type wherein interconnection of the fiber layers is made with a binder warp, i.e. in the final papermachine screen the binder threads extend in the cross-machine direction. A similar papermachine screen has been known from German Offenlegungsschrift No. 2,917,694 which, however, is woven flat and contains binder weft wires also in the cross-machine direction.

Papermachine screens made in accordance with these prior art techniques, i.e., with binder wires in the cross-machine direction, are not always satisfactory. In particular, when used in kraft, paperboard or cardboard machines they do not exhibit a sufficiently long service life.

It is therefore a primary object of the present invention to provide a composite fabric of the previously mentioned type having a long service life when used in kraft, paperboard and cardboard machines as well as other types of papermachines.

SUMMARY OF THE INVENTION

In accordance with the principles of the present invention, the above and other objects are realized in a composite fabric wherein at least two fabric layers are formed by transverse and longitudinal threads and are interconnected by transversely or by longitudinally extending threads and wherein at least part of the transversely and, in addition, at least part of the longitudinally extending threads are woven into the upper and into the lower fabric layer.

A composite fabric with these features exhibits a close and firm connection between the two fabric layers. Relative movement between the upper and lower fabric layers is thus significantly limited. It is also preferable that a portion of the interconnecting threads extends substantially normal to the plane of the composite fabric in places where it changes from the upper fabric layer to the lower fabric layer. This renders the connection between the fabric layers still firmer.

The basic idea underlying the present invention is to prevent as far as possible any relative movement between the upper and the lower fabric layers in all three directions of space. Surprisingly, it has been found that this firm bond of the upper to the lower fabric layer reduces the overall stress to which the threads connecting the fabric layers are subjected. The connecting threads are thus not destroyed, thereby rendering the papermachine screen useless, long before the lower fabric layer is worn through.

The threads connecting the two fabric layers may be binder threads such as those known, for example, from German Offenlegungsschriften Nos. 2,445,184 and 2,455,185. Binder threads are threads interwoven and used in addition to the threads forming the fabric layer. Thus, for example, after every fourth longitudinal thread of the upper fabric layer and likewise after every fourth transverse thread of the upper fabric layer a binder thread may be additionally interwoven into the fabric layer disposed therebeneath, thereby bonding the two fabric layers to each other.

In the manufacture of paper types that are particularly prone to marking, it is preferable, in accordance with the invention, that the fabric layers be bonded together by their own structural transverse and longitudinal threads. This reduces somewhat the risk of marking as compared to the use of binder threads because binder threads, even though generally comprising very thin plastic wire, are alien to the weave of the fabric layers, i.e. they disturb the regularity and uniformity of the fabric weave. This is particularly so at the binding points where the binder threads reduce the mesh opening and thereby reduce the screen permeability.

The term "structural threads" as used herein designates the transverse and longitudinal threads woven in a specific fabric weave, e.g. twill or satin, and forming the individual fabric layers. Bonding or interconnecting the fabric layers together by their structural threads results in a particularly tight bond between the layers. While binder threads are relatively loosely inserted into the fabric interstices and pass over the threads of the individual fabric layers only over short lengths, mostly over only one thread, a structural thread is an inseparable component of a fabric layer and is especially firmly anchored at least in the fabric layer to which it belongs. On the other hand, binder threads, in general, can pass only about one, two, or at best three threads of a layer because if floated over a longer distance in one fabric layer, the interstices of the fabric layer would become too impervious.

When fabric layers are interconnected by their structural threads the aforementioned risk attendant the use of binder threads does not exist because the structural threads are not additionally interwoven, but instead are intimately and firmly connected from the first to the remaining part of the fabric layer. When one of the structural threads of one fabric layer is passed around a thread of the next fabric layer, the two fabric layers are rigidly connected. Bonding of the fabric layers both by the longitudinal and by the transverse structural threads makes it impossible for the fabric layers to move relative to one another both in the longitudinal and in the transverse direction.

When two fabric layers are bonded together by way of their structural threads preferably the structural transverse and longitudinal threads of the fabric layer made up of thinner threads are used to bond the fabric layers one to the other. Normally these are the threads of the upper fabric layer. If the thicker threads of the lower fabric layer were interwoven with the finer, upper fabric layer, this would unacceptably disturb the uniformity of the permeability and of the surface of the upper fabric layer.

In general, it is not necessary that each structural transverse and longitudinal thread of the upper fabric layer be also woven into the lower fabric layer. In practice, a sufficiently firm bond between the two fabric layers may be realized when, for example, every fourth or sixth transverse thread and longitudinal thread is passed around a longitudinal or transverse thread of the lower fabric layer after each fourth or sixth longitudinal or transverse thread of the upper fabric layer, respectively.

The dimples formed in the upper fabric layer in the places where the structural threads are woven into the lower fabric layer are larger than those formed when the fabric layers are bonded together by way of additional binder wires, particularly when the fabric layers are interconnected by binder wire made from softer material or by especially fine binder threads. Therefore, in practice, it still depends on the acceptable degree of marking of the paper web by the dimples, on the degree of mechanical stress on the screen, and on the requirements of uniformity of screen permeability as to whether it is more favorable to interconnect the fabric layers by additional binder threads or by their own structural transverse and longitudinal threads.

Advantageously, the upper fabric layer may comprise polyester monofilament as may the lower fabric layer; in the latter the transverse threads may also be alternating polyamide and polyester monofilaments. As is customary in multi-layer papermachine clothing, the lower fabric layer may comprise a thicker wire and may have a coarser weave. Polyamide has proved to be particularly suited as material for the binder threads. Also, the composite fabric can be woven flat or endless.

DETAILED DESCRIPTION OF THE DRAWINGS

The above and other features and aspects of the present invention will become more apparent upon reading the following detailed description in conjunction with the accompanying drawings, in which.

Figure 2:
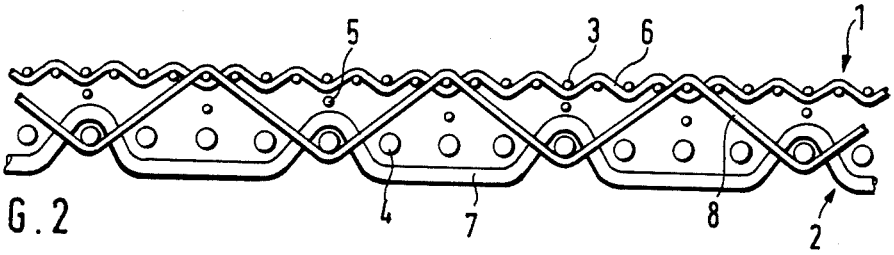
FIG. 2 is a section along the transverse wires of the composite fabric of FIG. 1.
Figure 3:
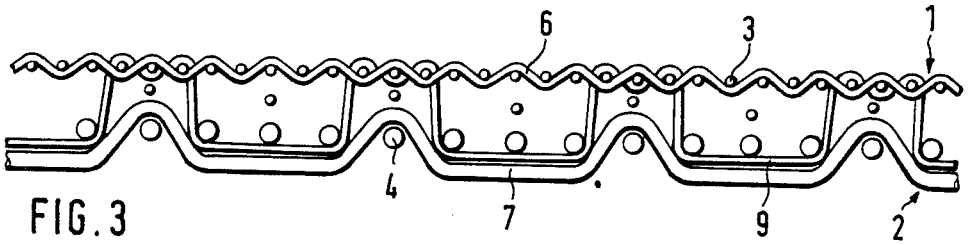
Figure 4:
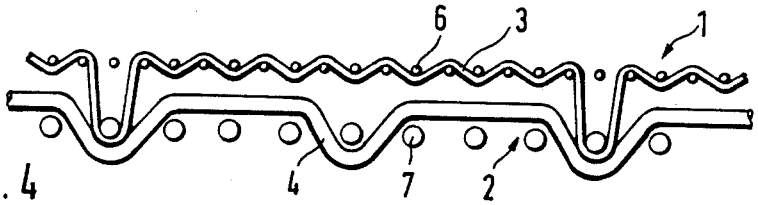
Figure 5:
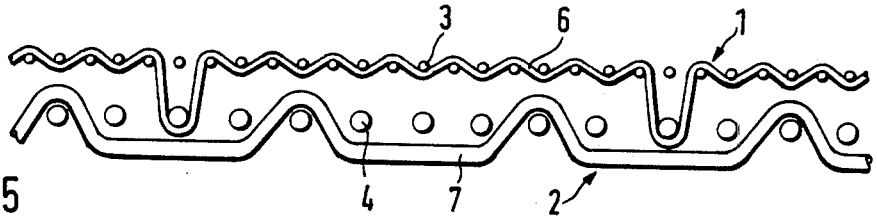

FIG. 3 is a section similar to that of FIG. 2 of a composite fabric wherein the course of the interconnecting binder threads is such as to give an especially firm bond to the fabric layers; and, FIGS. 4 and 5 are sections in the longitudinal and in the transverse direction through a composite fabric in which the fabric layers are interconnected by the structural threads of the upper fabric layer in accordance with the principles of the present invention.

DETAILED DESCRIPTION

Figure 1:
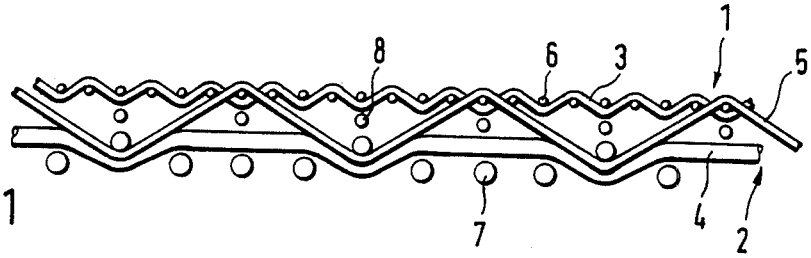
FIG. 1 is a section along the length direction and in parallel to the warp wires of a composite fabric in which the fabric layers are bonded or interconnected together by binder threads in accordance with the invention.

FIGS. 1 and 2 show a flat woven composite fabric in which the upper fabric layer 1 is made up of longitudinal extending warp wires 3 and transversely extending weft threads 6 woven in plain weave. The lower fabric layer 2 is made up of longitudinally extending warp wires 4 and transversely extending weft wires 7 and is woven in four-harness weave. The number of warp wires and weft wires in the lower fabric layer 2 is only half of that in the upper fabric layer 1. As can be seen, the wires in the lower fabric layer 2 are substantially thicker than those in the upper fabric layer 1.

Both fabric layers 1 and 2 are interconnected by longitudinally extending binder wires, the so-called binder warp 5, and by transversely extending binder wires, the so-called binder weft 8. Binder warp 5 and binder weft 8 form an intermediate fabric and are interwoven with every fourth weft wire 7 of the lower fabric layer 2 and every eighth weft wire 6 of the upper fabric layer 1, and with every fourth warp wire 4 of the lower fabric layer 2 and with every eighth warp wire 3 of the upper fabric layer 1, respectively.

As shown, binder warp 5 and binder weft 8 need not be interwoven with one another. However, the binder warp 5 might, for example, always pass over the binder weft 8, or vice versa.

The bond between the two fabric layers 1, 2 illustrated by FIGS. 1 and 2 largely prevents relative movement of the layers in the fabric plane. An even stronger connection between the two fabric layers 1, 2 can be achieved by selecting the course of the binder threads to be as shown in FIG. 3. This type of course prevents relative movement of the two fabric layers 1, 2 away from each other, i.e. normal to the fabric plane, as well as in the fabric plane. More particularly, as shown in FIG. 3, the binder threads extend substantially normal to the fabric plane between the point where they are interwoven into the lower fabric layer 2 and the point where they are interwoven into the upper fabric layer 1. In the case shown, the binder threads are the binder weft 9.

FIGS. 4 and 5 show a composite fabric made up of two fabric layers 1 and 2 identical with the fabric layers 1 and 2 of FIGS. 1 and 2. However, in FIGS. 4 and 5, the mode of interconnection of the two fabric layers is different and is in accordance with a second embodiment of the invention. More particularly, interconnection is accomplished by the structural longitudinal threads 3 and the structural transverse threads 6 of the upper fabric layer 1. As shown in FIG. 4, the longitudinally extending warp threads 3, at points spaced relatively far apart where they normally would be disposed below the transversely extending weft threads 6, are passed still further below and around the transversely extending weft threads 7 of the lower fabric layer 2. The longitudinal thread 3 loops around the transverse thread 7 of the lower fabric layer 2 at a point where a longitudinal thread 4 of the lower fabric layer 2 also extends beneath the transverse thread 7. The longitudinal thread 3 is thus protected against wear.

FIG. 5 shows a section in the transverse direction illustrating the interweaving of a transverse thread 6 of the upper fabric layer 1 at two points into the lower fabric layer 2. Here, too, the binding points are so selected that the transverse thread 6 normally would extend under a longitudinal thread 3 of the upper fabric layer 1, and the longitudinal thread 4 of the lower fabric layer 2, encircled by the transverse thread 6, extends over a longitudinal thread 7 of the lower fabric layer.

The invention is not limited to the types of weave illustrated in the drawings, i.e. the upper fabric layer 1 and the lower fabric layer 2 can be made in any desired type of weave. Also, the fabric layers may comprise monofilament or multifilament, and so can the binder threads.

EXAMPLE

The composite fabric comprises two fabric layers. The upper layer 1 is woven in plain weave and includes 20 longitudinal threads/cm and 22 transverse threads/cm.

The warp or longitudinal threads 3 are made of a high-shrinkage polyester monofilament, namely Trevira 940 having a relatively high elastic modulus. The diameter is 0.22 mm. The weft or transverse threads 6 are also of polyester monofilament, but of a low-shrinkage type having a low elastic modulus (Trevira 900). The diameter is likewise 0.22 mm.

The lower fabric layer 2 is a four-harness fabric woven in four-harness crossed twill weave. The fabric is woven as a weft runner, i.e. the long floats of the weft wires form the running side of the screen, while the long floats of the warp wires extend in the screen interior and are thus protected from wear.

The lower fabric layer 2 has 10 warp or longitudinal threads 4 and 11 weft or transverse threads 7 per centimeter of width. The longitudinal threads 4 are made of non-extensible, high-shrinkage polyester monofilament of the Trevira 940 type and have a diameter of 0.35 mm. The transverse threads 7, alternating in a 1:1 rhythm, are of a type 900 polyester monofilament of 0.40 mm diameter and polyamide-6.6 monofilament of 0.42 mm diameter.

The two fabric layers 1 and 2 are bonded together by the binder warp wires 5 and the binder weft wires 8 and 9, respectively. Both thread systems are made of polyamide-6.6 monofilament of 0.20 mm diameter.

The binder warp wires 5 are provided after every second warp wire 4 of the lower layer 2, and the binder weft wires 8 or 9, respectively, are provided after every second transverse wire 7 of the lower fabric layer 2. While all the binder warp wires 5 follow the same course and are interwoven as shown in FIG. 1, the course of the binder weft wires differs: the binder weft wire 8 alternatingly runs flat between the fabric layers 1 and 2, as shown in FIG. 2, and passes substantially vertically from one to the other layer, as shown in FIG. 3.

The completely manufactured and seamed fabric is provided with an antisoiling coat which keeps the interstices open and free of dirt particles from the paper stock and permeable even after a long period of use.

In all cases, it is understood that the above-identified arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. A composite fabric for use as clothing for the sheet forming section of a papermaking machine comprising at least two fabric layers formed by transverse and longitudinal threads and interconnected in that at least part of the transversely extending and, in addition, at least part of the longitudinally extending threads are woven into the upper and into the lower fabric layer, thereby limiting relative movement between the upper and lower fabric layers.

2. A composite fabric according to claim 1 further characterized in that a portion of the interconnecting threads, between points where the interconnecting threads pass from the upper fabric layer to the lower fabric layer, extend substantially normal to the plane of the composite fabric.

3. A composite fabric according to claim 2 further characterized in that the interconnecting threads are structural threads.

4. A composite fabric according to claim 2 further characterized in that the interconnecting threads are interwoven binder threads.

5. A composite fabric according to claim 1 further characterized in that the interconnecting threads are structural threads.

6. A composite fabric according to claim 1 further characterized in that the interconnecting threads are interwoven binder threads.

* * * * *